US008783852B2

(12) United States Patent
Noguchi

(10) Patent No.: US 8,783,852 B2
(45) Date of Patent: Jul. 22, 2014

(54) INTERMEDIATE TRANSFER BODY FOR TRANSFER INKJET PRINTING AND TRANSFER INKJET PRINTING APPARATUS

(75) Inventor: Mitsutoshi Noguchi, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/069,195

(22) Filed: Mar. 22, 2011

(65) Prior Publication Data

US 2011/0234729 A1 Sep. 29, 2011

(30) Foreign Application Priority Data

Mar. 24, 2010 (JP) ..... 2010-068192

(51) Int. Cl.

| | |
|---|---|
| ***B41J 2/01*** | (2006.01) |
| ***B41J 2/005*** | (2006.01) |
| *B41J 11/04* | (2006.01) |
| *B41J 11/057* | (2006.01) |

(52) U.S. Cl.

CPC *B41J 2/0057* (2013.01); *B41J 2/01* (2013.01); *B41J 11/04* (2013.01); *B41J 11/057* (2013.01)

USPC ..... 347/103; 347/101; 347/104

(58) Field of Classification Search

None

See application file for complete search history.

(56) References Cited

U.S. PATENT DOCUMENTS

| | | | | |
|---|---|---|---|---|
| 4,511,622 | A * | 4/1985 | Seimiya et al. | 428/323 |
| 5,389,958 | A * | 2/1995 | Bui et al. | 347/103 |
| 5,502,476 | A * | 3/1996 | Neal et al. | 347/103 |
| 5,553,845 | A * | 9/1996 | Sawa et al. | 271/314 |
| 5,669,052 | A * | 9/1997 | Kusaba et al. | 399/308 |
| 5,873,018 | A * | 2/1999 | Aoto et al. | 399/302 |
| 5,991,566 | A * | 11/1999 | Tanaka et al. | 399/101 |
| 6,935,733 | B2 * | 8/2005 | Fukuda et al. | 347/101 |
| 7,325,917 | B2 * | 2/2008 | Kohne et al. | 347/103 |
| 7,407,278 | B2 * | 8/2008 | Kohne et al. | 347/103 |
| 7,458,672 | B2 * | 12/2008 | Hirakawa | 347/101 |
| 7,810,922 | B2 * | 10/2010 | Gervasi et al. | 347/103 |
| 2006/0238593 | A1 * | 10/2006 | Kohne et al. | 347/103 |
| 2009/0027473 | A1 | 1/2009 | Taniuchi | |

FOREIGN PATENT DOCUMENTS

| | | | |
|---|---|---|---|
| JP | 3-169634 A | | 7/1991 |
| JP | 08025619 A | * | 1/1996 |
| JP | 2008-018719 A | | 1/2008 |

* cited by examiner

*Primary Examiner* — Alessandro Amari
*Assistant Examiner* — Leonard S Liang
(74) *Attorney, Agent, or Firm* — Canon U.S.A., Inc., IP Division

(57) ABSTRACT

There is provided an intermediate transfer body for transfer inkjet printing methods in which an image is formed by selectively applying image-forming ink using an inkjet device to the intermediate transfer body and then transferred from the intermediate transfer body to a recording medium to form a transferred image. The intermediate transfer body satisfies the relation E1<E2, where E1 is the compressive elastic modulus of the intermediate transfer body [Pa] measured in the direction parallel to that of the pressure generated during the compression process for image transfer, and E2 is the compressive elastic modulus of the intermediate transfer body [Pa] measured in the direction perpendicular to that of the pressure generated during the compression process for image transfer and parallel to that of conveyance of the recording medium. There is also provided a transfer inkjet printing apparatus having such an intermediate transfer body.

5 Claims, 1 Drawing Sheet

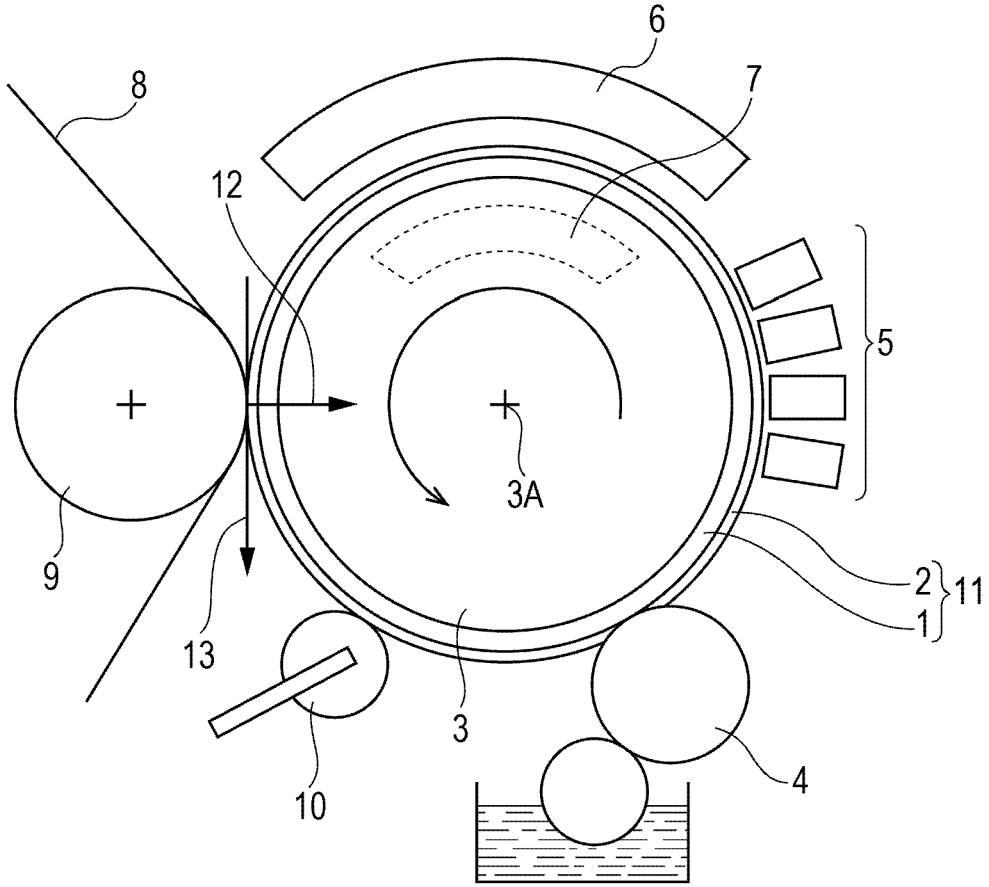
6
7
8
12
5
3A
9
2
11
1
13
3
10
4

INTERMEDIATE TRANSFER BODY FOR TRANSFER INKJET PRINTING AND TRANSFER INKJET PRINTING APPARATUS

BACKGROUND OF THE INVENTION

1. Field of the Invention

The present invention relates to an intermediate transfer body for transfer inkjet printing and a transfer inkjet printing apparatus.

2. Description of the Related Art

The transfer inkjet recording method, one of known printing techniques, is a recording method in which ink is ejected by an inkjet recording method onto an intermediate transfer body coated with reaction solution to form an intermediate image and then the formed intermediate image is transferred to a recording medium to form a transferred image.

Every image-forming apparatus for this transfer inkjet recording method has an intermediate transfer body for carrying an intermediate image. An example of the intermediate transfer bodies for known transfer inkjet recording schemes is that made of elastic material. Japanese Patent Laid-Open No. 3-169634 has proposed an intermediate transfer body containing silicone rubber exposed on its surface.

Japanese Patent Laid-Open No. 3-169634 states that an intermediate transfer body containing too soft a silicone rubber exposed on its surface may be pressed by the pressure generated during the image formation process to a greater extent than necessary and that this may cause defects on the resultant image. This publication also states that too hard a silicone rubber may inhibit the transfer of the image to a recording medium having a low surface smoothness and that this may affect the quality of the resultant image.

The transfer inkjet recording method can be used as a printing technique for producing many kinds of prints in a small number of lots only after its compatibility with a wide variety of recording media and the quality of the prints produced with it have been improved. If one wants to optimize the hardness of the rubber coating the intermediate transfer body, however, they will face a trade-off between this purpose and the requirements mentioned above and find it difficult in some cases to achieve these all. The present inventors have regarded to eliminate this trade-off the related art has faced as an important task.

SUMMARY OF THE INVENTION

Made in light of this existing problem, the present invention provides an intermediate transfer body for transfer inkjet printing that has a high image transfer performance on a wide variety of recording media and on which the image is prevented from shifting out of position while it is being transferred to a recording medium, thereby making it possible to produce high-quality prints. The present invention also provides a transfer inkjet printing apparatus having such an intermediate transfer body.

To this end, the present invention provides an intermediate transfer body for transfer inkjet printing methods in which image-forming ink (ink for forming some image) is selectively applied using an inkjet device to the intermediate transfer body to form an image and then a recording medium is pressed onto the image so that the image should be transferred from the intermediate transfer body to the recording medium to form a transferred image, with the intermediate transfer body satisfying the relation $E1<E2$, where E1 is the compressive elastic modulus of the intermediate transfer body [Pa] measured in the direction parallel to the direction of the pressure generated while the recording medium is pressed onto the intermediate transfer body, and E2 is the compressive elastic modulus of the intermediate transfer body [Pa] measured in the direction perpendicular to the direction of the pressure generated while the recording medium is pressed onto the intermediate transfer body and parallel to the direction of conveyance of the recording medium.

Additionally, the present invention provides a printing apparatus for transfer inkjet printing methods in which an image-forming ink is selectively applied using an inkjet device to an intermediate transfer body to form an image and then a recording medium is pressed onto the image so that the image should be transferred from the intermediate transfer body to the recording medium to form a transferred image.

In this way, the present invention provides an intermediate transfer body for transfer inkjet printing that has a high image transfer performance on a wide variety of recording media and on which the image is prevented from shifting out of position while it is being transferred to a recording medium, thereby making it possible to produce high-quality prints, and also provides a transfer inkjet printing apparatus having such an intermediate transfer body.

Further features of the present invention will become apparent from the following description of exemplary embodiments with reference to the attached drawing.

BRIEF DESCRIPTION OF THE DRAWING

FIGURE is a schematic diagram that illustrates an example of the transfer inkjet printing apparatus according to the present invention.

DESCRIPTION OF THE EMBODIMENTS

The present invention provides an intermediate transfer body for transfer inkjet printing and a transfer inkjet printing apparatus.

Transfer Inkjet Printing

An example of the transfer inkjet printing methods based on the use of the intermediate transfer body according to the present invention is that including the following processes: 1) Selectively applying image-forming ink using an inkjet device to the surface of the intermediate transfer body to form an intermediate image; 2) Pressing a recording medium onto the intermediate transfer body, which retains the intermediate image, in order that the image should be transferred from the intermediate transfer body to the recording medium to form a transferred image. If necessary, the transfer inkjet printing method can further include, before Process 1, a process of applying reaction solution (the first liquid) for reducing the fluidity of the image-forming ink (the second liquid) to the intermediate transfer body. When this reaction solution application process is included, the image-forming ink will be applied to the intermediate transfer body coated with the first liquid. Additionally, the transfer inkjet printing method can include, between Processes 1 and 2, a process of completely or partially removing the liquid content from the formed intermediate image. Furthermore, the transfer inkjet printing method can include, after the image transfer process, a process of coating the transferred image.

FIGURE is a schematic diagram that illustrates a transfer inkjet printing apparatus (an image-forming apparatus) according to the present invention. The following describes an embodiment of the transfer inkjet printing apparatus according to the present invention and outlines a printing method based on the use of this printing apparatus.

Supporting Member

The intermediate transfer body for transfer inkjet printing according to the present invention (hereinafter also simply referred to as the intermediate transfer body) can be placed on a supporting member, and this supporting member need have a structural strength high enough to ensure the accuracy in conveying a recording medium and a sufficient durability. The materials that can be used to make the supporting member include metals, ceramics, and resins. In particular, the following can be used because they are rigid enough to withstand the pressure generated during the image transfer process, can be prepared with a high dimensional accuracy, and the movement of a structure made from any of them is highly controllable owing to the low inertia of the material: aluminum, iron, stainless steel, acetal resin, epoxy resin, polyimide, polyethylene, polyethylene terephthalate, nylon, polyurethane, silica ceramics, and alumina ceramics. These materials can be used in combination.

The supporting member can be used in any form compatible with the form of the recording apparatus to be used, the mode of image transfer to the recording medium, and other conditions; it can be a roller or a belt or have any other appropriate structure. A supporting member shaped into a drum or a treadmill-like woven belt allows the continuous and repeated use of a single intermediate transfer body and thereby provides a constitution highly favorable in respect of productivity.

Intermediate Transfer Body

The transfer inkjet printing apparatus according to the present invention has a supporting member 3 and an intermediate transfer body 11 held on it, and the intermediate transfer body 11 is the intermediate transfer body according to the present invention. The intermediate transfer body serves as a substrate that retains ink and on which an image is formed. The intermediate transfer body can have any laminar constitution (e.g., the number of layers and the composition of each layer) satisfying the requirement of the compressive elastic modulus of the whole intermediate transfer body.

For example, FIGURE illustrates an intermediate transfer body having two layers. In this drawing, the supporting member 3, which is for transmitting the force needed to move the intermediate transfer body, has a first elastic layer 1 wrapped therearound, and this elastic layer is covered with a second elastic layer 2 on which an image is to be formed. The intermediate transfer body can have three or more layers. For example, the second elastic layer 2 can be covered with a layer having projections and depressions on its surface. Moreover, the intermediate transfer body 11 can have only a single elastic layer or have only a layer having projections and depressions on its surface. When two elastic layers are used, these elastic layers can be members (layers) having the same composition or members with different compositions. The intermediate transfer body according to the present invention and the supporting member holding it can have any form as a whole, for example, a sheet, a roller, a drum, a belt, or a treadmill-like web. The form of this unit can be chosen as determined by the form of the printing apparatus to be used, the mode of image transfer to the recording medium, and other conditions. As for size, the intermediate transfer body can have any size as determined by the user's desired size of the finished image.

The intermediate transfer body can have releasing properties on its surface, or more specifically an ability to easily release the ink image formed thereon (i.e., the image formed from ink on the intermediate transfer body). Good releasing properties on the surface further improve the image transfer performance of the intermediate transfer body. Here, when the intermediate transfer body has only one layer, the surface represents the surface of this layer, and when the intermediate transfer body has two or more layers, the surface represents the surface of the outermost one. Silicone rubbers and fluorocarbon rubbers have a low surface energy and good releasing properties and thus constitute a group of the best materials for the layer or the outermost layer of the intermediate transfer body. Thus, the intermediate transfer body according to the present invention can contain fluorocarbon rubber and/or silicone rubber exposed on its surface. However, the materials that can be used to form the layer or the outermost layer of the intermediate transfer body are not limited to these; the material for the layer or the outermost layer of the intermediate transfer body can be selected from all kinds of materials that have good releasing properties, good elastic properties, and a high image transfer rate (i.e., the efficiency of the intermediate transfer body in transferring the ink image to a recording medium). Furthermore, when the intermediate transfer body has two or more layers, such materials can be used not only in the outermost layer but also in the other layer(s). Moreover, as mentioned above, constitutions in which the intermediate transfer body has two or more layers are also allowed, and when such a constitution is used, any appropriate laminar constitution can be used.

Further examples of the materials for the layer(s) of the intermediate transfer body include resins, ceramics, and other appropriate materials. Kinds of elastomeric materials and rubber materials can also be used because they are good in the properties mentioned above and easy to process. Examples of usable elastomeric materials and rubber materials include fluorosilicone rubber, phenyl silicone rubber, fluorocarbon rubber, chloroprene rubber, nitrile rubber, ethylene propylene rubber, natural rubber, styrene rubber, isoprene rubber, butadiene rubber, ethylene-propylene-butadiene copolymers, and nitrile butadiene rubber. In particular, silicone rubbers, fluorosilicone rubbers, phenyl silicone rubbers, fluorocarbon rubbers, and chloroprene rubbers have a high dimensional stability, are very durable, and highly resistant to heat. Furthermore, the intermediate transfer body according to the present invention can be a laminate of layers made of different materials (i.e., a structure having two or more layers with different compositions), for example, a laminated structure in the form of a polyurethane belt thinly coated with silicone rubber. The layer(s) of the intermediate transfer body can be subjected to any appropriate surface treatment before use. Examples of appropriate surface treatments include the following: exposure to flame, corona, or plasma; polishing; coarsening; irradiation with active radiation (e.g., UV, IR, or RF); ozonization; treatment with a surfactant. Such kinds of surface treatments can be used in combination of two or more kinds. The intermediate transfer body according to the present invention can have a surface-treated layer with a thickness on the order of several micrometers. Furthermore, some kind of adhesive material, double-sided adhesive tape, or the like can exist between the intermediate transfer body and the supporting member to fix the intermediate transfer body in position.

Compressive Elastic Moduli of the Intermediate Transfer Body

Additionally, the intermediate transfer body according to the present invention, from which an image is transferred onto paper or some other kind of recording medium by compression, can have some degree of elasticity as a whole. In general, an intermediate transfer body can transfer an image to a wide variety of recording media well when its compressive elastic modulus is relatively low. The intermediate transfer body is pressed by a recording medium to transfer the image and thus is required to deform to fit the surface shape of the recording medium. When a recording medium having a greater surface roughness than other kinds is used, an effective way to make the intermediate transfer body deform to fit the surface shape of the recording medium is to use an intermediate transfer body having a low compressive elastic modulus. However, such an intermediate transfer body having a low compressive elastic modulus may deform to a too large extent, and this has actually caused the image to shift out of position while it is transferred to a recording medium, resulting in a reduced quality of the image. In general, therefore, the deformation of an intermediate transfer body can be prevented more and more effectively as the compressive elastic modulus of the intermediate transfer body increases.

As can be seen from this, there is a trade-off between ensuring a high image transfer performance of an intermediate transfer body and preventing the image from shifting out of position following the deformation of the intermediate transfer body. However, the present inventors have found it possible to mitigate this trade-off by dividing the compressive elastic modulus of an intermediate transfer body into two components in different directions, one parallel to the direction of the pressure generated while a recording medium is pressed onto the intermediate transfer body, and the other perpendicular to the direction of the pressure generated while a recording medium is pressed onto the intermediate transfer body and parallel to the direction of conveyance of the recording medium. Here, the direction parallel to the direction of the pressure generated while a recording medium is pressed onto the intermediate transfer body is the direction indicated by the arrow 12 in FIGURE; in other words, this direction is represented by the shortest segment drawn from the surface of the intermediate transfer body to the center of the supporting member. On the other hand, the direction perpendicular to the direction of the pressure generated while a recording medium is pressed onto the intermediate transfer body and parallel to the direction of conveyance of the recording medium is the direction indicated by the arrow 13 in FIGURE; in other words, this direction is represented by the tangent to the intermediate transfer body drawn in the direction of conveyance of the recording medium (the direction in which the recording medium advances). Hereinafter, these two directions are also referred to as the parallel-to-pressure direction and the perpendicular-to-pressure direction, and the two components of the compressive elastic modulus of an intermediate transfer body are also referred to as the parallel-to-pressure compressive elastic modulus and the perpendicular-to-pressure compressive elastic modulus.

More specifically, the present inventors have found the following two facts: Setting the parallel-to-pressure compressive elastic modulus of an intermediate transfer body at a relatively low value improves the image transfer performance of the intermediate transfer body; Setting the perpendicular-to-pressure compressive elastic modulus of an intermediate transfer body at a relatively high value prevents the image from shifting out of position following the deformation of the intermediate transfer body. Considering both the facts together, the present inventors have concluded that an intermediate transfer body should satisfy the following requirement to have a sufficient image transfer performance on a wide variety of recording media while being able to providing a high-quality transferred image regardless of the kind of recording medium.

When the parallel-to-pressure and perpendicular-to-pressure compressive elastic moduli are expressed as E1 [Pa] and E2 [Pa], respectively, it is important that $E1<E2$. Preferably, $E1\times1.5<E2$. When $E1<E2$, the amount of deformation of the intermediate transfer body is smaller in the perpendicular-to-pressure direction than in the parallel-to-pressure direction. With this anisotropy in compressive elastic modulus, the intermediate transfer body is superior to those having no such anisotropy in image transfer performance on a wide variety of recording media and the quality of the transferred image. The present inventors have also found that setting the degree of this anisotropy to satisfy the relation $E1\times1.5<E2$ allows E2 to be relatively high even when E1 is relatively low, and thus is a further effective way to make the intermediate transfer body have a sufficient image transfer performance on a wide variety of recording media while being able to provide a high-quality transferred image.

For example, when the recording medium is paper, the parallel-to-pressure compressive elastic modulus of the intermediate transfer body is preferably in the range of 3 MPa to 50 MPa, inclusive. Materials with a degree of hardness in the range of 10 to 80, inclusive, on a Type-A durometer hardness basis (defined in JIS K6253) have degrees of elasticity roughly corresponding to the range of compressive elastic modulus specified above (3 MPa to 50 MPa, inclusive). Here, the degree of elasticity is the degree of compressive elasticity determined from the amount of the strain caused by a specified amount of compressive force. The definition of the compressive elastic modulus is provided in JIS K6254:2003. A method for measuring the compressive elastic modulus is also provided in JIS K6254:2003, and the values measured in this method can be used in the present invention. In practical settings, however, one can use the values measured in any other method whose accuracy and precision have been fully established. Examples of the methods that can be used for this purpose include those based on dynamic mechanical analysis (DMA). To be exact, the compressive elastic modulus obtained from the amount of strain measured by placing an intermediate transfer body (or more specifically a sample taken from it) under compressive stress applied in the direction parallel to that in which stress will be generated while the intermediate transfer body is under compression for image transfer is referred to as the parallel-to-pressure compressive elastic modulus of the intermediate transfer body.

As mentioned above, when a recording medium having a greater surface roughness than other kinds is used, an effective way to make the intermediate transfer body deform to fit the surface shape of the recording medium is to use an intermediate transfer body having a low compressive elastic modulus. More specifically, an intermediate transfer body having a parallel-to-pressure compressive elastic modulus falling within the range of 10 MPa to 30 MPa, inclusive, can easily have a sufficient image transfer performance on a wide variety of recording media. Materials having a degree of hardness in the range of 40 to 60, inclusive, on a Type-A durometer hardness basis (defined in JIS K6253) have degrees of elasticity roughly corresponding to the range of compressive elastic modulus specified above (10 MPa to 30 MPa, inclusive). As can be seen from this, if one wants to give an intermediate transfer body a sufficient image transfer performance on a wide variety of recording media, or to get the intermediate transfer body to deform to fit the surface shape of a wide variety of recording media, it is important that the intermediate transfer body can deform to a great extent in the parallel-to-pressure direction. In other words, it is important that the parallel-to-pressure compressive elastic modulus of the intermediate transfer body is low.

Incidentally, when the intermediate transfer body has two or more layers, the compressive elastic modulus used in the present invention means the compressive elastic modulus measured with both or all the layers included.

When the intermediate transfer body has projections and depressions formed on its surface, samples taken from it can be processed to be suitable for dynamic mechanical analysis. For example, such a treatment as removing the projections and depressions by polishing or in any other appropriate way makes the surface of the intermediate transfer body flat and smooth, and the processed intermediate transfer body, the surface of which is flat and smooth, can provide samples for the measurement of the compressive elastic modulus as a substitute of the intermediate transfer body having projections and depressions on its surface. When the intermediate transfer body has projections and depressions formed on its surface, the surface roughness ($R_a$) of the intermediate transfer body is preferably equal to or smaller than 5 μm and more preferably equal to or smaller than 2 μm.

As mentioned above, the deformation of an intermediate transfer body can be prevented more and more effectively as the compressive elastic modulus of the intermediate transfer body increases. In particular, it is important that the intermediate transfer body can deform only to a small extent in the perpendicular-to-pressure direction. In other words, it is important that the perpendicular-to-pressure compressive elastic modulus of the intermediate transfer body is high. For further effective prevention of the deformation of the intermediate transfer body and a more improved quality of the transferred image, the perpendicular-to-pressure compressive elastic modulus (E2) is preferably in the range of 3 MPa to 100 MPa, inclusive, and more preferably in the range of 10 MPa to 40 MPa, inclusive. Materials having a degree of hardness in the range of 10 to 100, inclusive, on a Type-A durometer hardness basis (defined in JIS K6253) have degrees of elasticity roughly corresponding to the first specified range of compressive elastic modulus (3 MPa to 100 MPa, inclusive). Also, materials having a Type-A durometer hardness in the range of 40 to 70, inclusive, have degrees of elasticity roughly corresponding to the second specified range of compressive elastic modulus (10 MPa to 40 MPa, inclusive).

To easily satisfy the relation E1<E2, the intermediate transfer body can contain needle-shaped fillers. These needle-shaped fillers, when they are oriented in the perpendicular-to-pressure direction, give rise to anisotropy in the compressive elastic modulus of the intermediate transfer body, thereby making it possible to adjust E1 and E2 to their respective desired values. When the intermediate transfer body has two or more layers, one or more of these layers can contain such needle-shaped fillers. Spherical fillers, a kind of commonly used filler, are fillers having an aspect ratio close to 1, whereas needle-shaped fillers are fillers having an aspect ratio exceeding 1. Commonly used kinds of needle-shaped fillers have an aspect ratio on the order of 1.5 to 50; however, the needle-shaped fillers mentioned above are not limited to these kinds, and any known needle-shaped fillers can be used as needed. Specific examples of the kinds of needle-shaped fillers that can be used in the present invention include the following: alumina fiber, carbon fiber, glass fiber; needle crystals of aluminum borate, silicon carbide, silicon nitride, potassium titanate, or zinc oxide. Not all the individual needle-shaped fillers need be oriented in the perpendicular-to-pressure direction; the needle-shaped fillers can provide their effect described above when they are generally oriented in that direction. If necessary, the compressive elastic modulus and the anisotropy in compressive elastic modulus of the intermediate transfer body can be adjusted to their respective desired value and degree by changing the characteristics of the needle-shaped fillers including their material, shape, and amount. Any known orientation technique can be used as needed to make the needle-shaped fillers oriented. Specific examples of the techniques that can be used for this purpose include applying a magnetic field to the fillers before the rubber material in the individual layers of the intermediate transfer body loses its fluidity, applying an electric field to the fillers in a similar way, and making use of the flow shear stress generated during the molding process.

To easily satisfy the relation E1<E2, the intermediate transfer body can contain an orientable compound. Here, the orientable compound means a compound whose molecules or crystals can be oriented in a certain direction. This type of compound, when its molecules or crystals are oriented in the perpendicular-to-pressure direction, gives rise to anisotropy in the compressive elastic modulus of the intermediate transfer body, thereby making it possible to adjust E1 and E2 to their respective desired values. When the intermediate transfer body has two or more layers, one or more of these layers can contain such an orientable compound, and each of the layers of the intermediate transfer body can contain both needle-shaped fillers and an orientable compound. A specific example of orientable compounds is polyimide-modified silicone. When polyimide-modified silicone is used, its molecular weight is preferably in the range of 1000 to 100000, inclusive. For example, molecular chains with aromatic rings or a linear backbone are known to be easily oriented through their interactions. The orientable compound can provide its effect described above when their molecules or crystals are generally oriented in the perpendicular-to-pressure direction. If necessary, the compressive elastic modulus and the anisotropy in compressive elastic modulus of the intermediate transfer body can be adjusted to their respective desired value and degree by changing the characteristics of the orientable compound including its structure and amount. Any known orientation technique can be used as needed to make the molecules or crystals of the orientable compound oriented. Specific examples of the techniques that can be used for this purpose include applying a magnetic field to the orientable compound before the rubber material in the individual layers of the intermediate transfer body loses its fluidity, applying an electric field to the orientable compound in a similar way, and making use of the flow shear stress generated during the molding process. The total thickness of the layers constituting the intermediate transfer body is preferably in the range of 100 μm to 5 mm, inclusive, and more preferably in the range of 100 μm to 2 mm, inclusive.

Reaction Solution (the First Liquid)

The transfer inkjet printing methods based on the use of the intermediate transfer body according to the present invention can include the use of reaction solution (the first liquid) that can form a high-viscosity ink image upon contact with the coloring material and/or related components contained in the ink. The kinds of reaction solutions that can be used in the present invention are those containing an ink-thickening agent. Here, the ink-thickening agent means an agent that chemically reacts with or physically adsorbs the coloring material, resin, and/or any other ingredient of ink upon contact with the ink to increase the overall viscosity of the ink. In addition to this, however, the ink-thickening agent includes substances that make the coloring material or any other ingredient of ink aggregated to cause a localized increase in the viscosity of the ink. On the intermediate transfer body, this agent acts on one or more ingredients of the ink and, as a result, reduces the overall fluidity of the ink; it will provide an effect of preventing viscosity-related problems encountered during the image formation process, in particular, bleeding (blurring of ink) and beading (mixing of different kinds of inks). A more specific explanation of this effect is as follows:

Image formation with an inkjet device often involves the use of a large amount of ink per unit area, and, in such cases, bleeding and beading are likely to occur; however, the reaction solution, the first liquid, applied to the intermediate transfer body, reduces the fluidity of the ink so that bleeding, beading, and other viscosity-related problems will be prevented from occurring during the image formation process; thus, the resultant image will be of high quality and strongly fixed in position. The ink-thickening agent used in the present invention can be any kind compatible with the image-forming ink to be used. For example, dye ink greatly benefits from a polymer coagulant, and pigment ink, which contains fine particles dispersed therein, greatly benefits from liquid containing polyvalent metal ions and from a pH-adjusting agent such as acid buffer solution. Further examples of usable ink-thickening agents are compounds having two or more ionic groups such as cationic polymers. These compounds can be used in combination of two or more kinds.

Specific examples of the polymer coagulants that can be used as the ink-thickening agent include cationic polymer coagulants, anionic polymer coagulants, nonionic polymer coagulants, and amphoteric polymer coagulants. When liquid containing metal ions is used as the ink-thickening agent, any kind of metal ion species and any concentration can be used as permitted by the conditions. Some specific examples of the metal ion species that can work in the ink-thickening agent are divalent metal ion species such as $Ca^{2+}$, $Cu^{2+}$, $Ni^{2+}$, $Mg^{2+}$, and $Zn^{2+}$, and trivalent metal ion species such as $Fe^{3+}$ and $Al^{3+}$. Liquid containing such a metal ion species can be applied in the form of an aqueous solution of the appropriate metal salt. Examples of the anionic species that can form salts with the metal ion species listed above include $Cl^-$, $NO_3^-$, $SO_4^{2-}$, $I^-$, $Br^-$, $ClO_3^-$, and $RCOO^-$ (R: an alkyl group). When aqueous solution of a metal salt is used as the ink-thickening agent, the concentration of the metal salt is preferably equal to or higher than 0.01 mass % and more preferably equal to or higher than 0.1 mass %; however, it is preferably not higher than 20 mass %.

Specific examples of the pH-adjusting agents that can be used as the ink-thickening agent include solutions with pH less than 7, namely acidic solutions. More specific examples include inorganic acids such as hydrochloric acid, phosphoric acid, sulfuric acid, nitric acid, and boric acid, and organic acids such as oxalic acid, polyacrylic acid, acetic acid, glycolic acid, malonic acid, malic acid, maleic acid, ascorbic acid, succinic acid, glutaric acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, and nicotinic acid. Derivatives of these compounds and solutions of salts these compounds form can also be used.

Acid buffer solution (or simply buffer), which has a pH buffering capacity, can also be used as the ink-thickening agent because it reduces the change in the pH of the reaction solution following the decrease in the apparent concentration due to the entry of the ink and thereby prevents the reaction solution from losing a considerable portion of its reactivity with the ink. Instead of containing acid buffer solution, the reaction solution can contain a buffering compound in itself to have a pH buffering capacity. Specific examples of the buffering compounds that can be used for this purpose include acetates such as sodium acetate, potassium acetate, and lithium acetate, hydrogen phosphates, hydrogen carbonates, and hydrogen salts of polyhydric carboxylic acids such as sodium hydrogen phthalate and potassium hydrogen phthalate. Besides phthalic acid, specific examples of usable polyhydric carboxylic acids include malonic acid, maleic acid, succinic acid, fumaric acid, itaconic acid, isophthalic acid, terephthalic acid, adipic acid, sebacic acid, dimer acids, pyromellitic acid, and trimellitic acid. Furthermore, any other compound known to have a pH buffering capacity when added to solution is allowed. It is also allowed to use acid buffer solution directly as the reaction solution; the content ratio of acid buffer solution can be 100 mass % relative to the total mass of the reaction solution. When acid buffer solution is used as the ink-thickening agent, the lower limit of the content ratio of acid buffer solution in the reaction solution is not particularly limited; however, it is preferably equal to or higher than 5 mass %.

The reaction solution, the first liquid, can contain some kind of resin to improve the image transfer performance of the intermediate transfer body or the robustness of the transferred image. The addition of resin can further improve the image transfer performance of the intermediate transfer body or further increase the mechanical strength of the coating formed by the ink. Some kinds of resins may possibly improve the waterproofness of the image. Any kind of resin compatible with the ink-thickening agent can be used as needed. Examples of usable resins include polyvinyl alcohol and polyvinyl pyrrolidone. Besides these, resins that react with one or more ingredients of the ink to form cross-links can also be used. Examples of this type of resin include oxazoline and carbodiimide, which react with carboxylic acids, frequently used dispersants for the coloring material of ink, to form cross-links. The resin can be dissolved in the solvent of the reaction solution, the first liquid, or have the form of an emulsion or a suspension in the first liquid. The content ratio of resin in the reaction solution is preferably in the range of 1 mass % to 50 mass %, inclusive, relative to the total mass of the reaction solution.

If necessary, it is allowed to add a surfactant to the reaction solution, the first liquid, to adjust the surface tension of the reaction solution. Any known kind of surfactant, such as an ionic, nonionic, cationic, or anionic one, can be used as needed, but with caution because some kinds of surfactants may have an adverse effect on the reaction solution and the ink and interfere with the image formation process.

Reaction solution (the first liquid) constituted as above is applied to the intermediate transfer body before ink (the second liquid) is applied using an inkjet device. Any known appropriate technique can be used to apply the reaction solution. Examples of the techniques appropriate in this process include die coating, blade coating, and gravure roller coating with or without offset printing rollers. As a quick and high-precision application technique, the use of an inkjet device is also allowed. Once ink is applied using an inkjet device to the image-forming surface (i.e., the area on which the image will be formed) of the intermediate transfer body coated with the reaction solution, the reaction solution and the ink come into contact on this surface and form a high-viscosity ink image as an intermediate image. In this way, bleeding and beading on the intermediate image can be further effectively prevented. Incidentally, the transfer inkjet printing apparatus illustrated in FIGURE has a roller-based applicator 4 as a device for applying reaction solution, the first liquid, to the intermediate transfer body.

Image Formation

In FIGURE, the intermediate transfer body 11 rotates on the rotation shaft 3A of a supporting member 3 counterclockwise in the drawing at a certain peripheral speed. To this intermediate transfer body, ink is selectively applied using an inkjet device 5 to form an image. Examples of the inkjet devices that can be used in the present invention include those that eject ink by activating electro-thermal transducers to make the ink boil and generate bubbles, those that eject ink by making use of electro-mechanical transducers, and those that eject ink by making use of static electricity. Any kind of ink jet device that has been proposed as one for inkjet liquid ejection techniques can be used. In particular, inkjet devices based on electro-thermal transducers can provide high-speed and high-density printing. The form of the whole inkjet device is not particularly limited. Even a linear inkjet head, which has ink nozzles arranged perpendicular to the direction of movement of the intermediate transfer body, or a shuttling inkjet head, which records an image while running perpendicular to the direction of movement of the intermediate transfer body, can be used.

Ink (the Second Liquid)

Examples of the inks for image formation that can be used in the present invention as the second liquid include commonly used inkjet inks, or more specifically inks obtained by dissolving and/or dispersing dye, pigment, or any other kind of coloring material in a medium. In particular, pigment ink makes it possible to produce prints favorable with regard to weather fastness and color developability. In light of environmental protection and odor, aqueous ink, which contains water as an ingredient, can be used. In particular, inks whose main solvent is water, or more specifically inks containing water at a content ratio equal to or higher than 45 mass %, can be used. The content ratio of coloring material in the ink is preferably equal to or higher than 0.1 mass % and more preferably equal to or higher than 0.2 mass %. However, the content ratio of coloring material in the ink is preferably equal to or lower than 15.0 mass % and more preferably equal to or higher than 10.0 mass %. The coloring material mentioned here includes dyes, pigments, related resins, and other similar materials, and known coloring materials such as those mentioned in Japanese Patent Laid-Open No. 2008-018719 can be used as the coloring material.

When pigment is contained in the ink, its form is not particularly limited; for example, it can be a self-dispersion pigment, a resin-dispersed pigment, or a microcapsule pigment. As for the dispersant for the pigment, examples of usable ones are water-soluble dispersion resins having a weight average molecular weight in the range of 1000 to 15000, inclusive. Specific examples of this type of dispersant include vinyl water-soluble resins, and block or random copolymers and their salts of the following compounds: styrene and its derivatives, vinylnaphthalene and its derivatives, α,β-ethylenic unsaturated carboxylic acid-aliphatic alcohol esters, acrylic acid and its derivatives, maleic acid and its derivatives, itaconic acid and its derivatives, and fumaric acid and its derivatives. The ink can contain water-soluble resin or a water-soluble cross-linking agent to improve the robustness of the transferred image. Any kind of water-soluble resin or water-soluble cross-linking agent can be used as long as it is compatible with the ingredients of the ink. For example, when water-soluble resin is used, the type of dispersion resin mentioned above can be directly used as the water-soluble resin. When a water-soluble cross-linking agent is used, oxazoline and carbodiimide will contribute to the stability of the ink. Besides these, reactive oligomers such as polyethylene glycol diacrylate and acryloyl morpholine can also be used. Furthermore, the ink can contain appropriate amounts of additives for its stable ejection from an inkjet device. Examples of the additives that can be used for this purpose, namely stable discharge of the ink, include alcohols such as ethyl alcohol and isopropyl alcohol, and surfactants. The ratio of the amount of pigment to that of dispersant in the ink is preferably in the range of 1:0.1 to 1:3 on a mass basis.

In printing techniques based on the use of the intermediate transfer body according to the present invention (transfer inkjet printing methods), the ink, in some cases, contains almost only a coloring material and a high-boiling organic solvent at the time when it is transferred to a recording medium, and thus it is effective to add in advance organic solvent in an appropriate amount so that the ink can be easily transferred. High-boiling, water-soluble organic solvents having a low vapour pressure can be used for this purpose. Examples of the organic solvents that can be used for this purpose include polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether, and glycerin. Such kinds of organic solvents can be used in combination of two or more kinds. The relative amounts of the individual ingredients of the ink are not particularly limited; they can be set as determined by the ejection capacity of the inkjet head to be used, the diameter of the nozzles, and other conditions for successful discharge of the ink. Needless to say, the intermediate image formed on the intermediate transfer body is a reverse image (the mirror image) of the intended finished image. When water is contained in the ink, the content ratio of water is preferably in the range of 30 mass % to 90 mass %, inclusive, relative to the total mass of the ink. When organic solvent is contained in the ink, the content ratio of the organic solvent is preferably in the range of 3 mass % to 70 mass %, inclusive, relative to the total mass of the ink.

Removal of Liquid Component

The transfer inkjet printing methods based on the use of the intermediate transfer body according to the present invention can include a process of completely or partially removing the liquid component from the intermediate image. This complete or partial removal of the liquid component from the intermediate image will very effectively prevent in the next process (the compression process for image transfer) the leakage or overflow of surplus liquid that may blur the image and/or lead to incomplete image transfer. Any known liquid-removing technique can be used as needed to remove water or any other kind of liquid component. For example, heating, blowing with low-humidity air, decompression, contact with absorbing material, and combinations of these are all usable. Furthermore, air-drying is also allowed. Incidentally, the transfer inkjet printing apparatus illustrated in FIGURE has a blower 6 and a heater 7 as liquid component-removing units. These units dry the ink image by removing the liquid component from it, and as a result the image will be very effectively prevented from being blurred during the image transfer process.

Image Transfer

In transfer inkjet printing methods, an (intermediate) image formed on an intermediate transfer body is pressed by a recording medium to be transferred from the intermediate transfer body to the recording medium to form a transferred image. In this process, as illustrated in FIGURE, a pressing roller 9 can be used with the intermediate transfer body 11 to press the recording medium 8 from both sides in order for efficient formation of the transferred image. Multiple-step pressing, which effectively prevents incomplete image transfer, is also allowed.

This image transfer process can be followed by an additional process in which the recording medium retaining the transferred image is pressed with fixing rollers to have an improved surface smoothness. When such an additional process is used, the fixing rollers can be preheated so that the transferred image can be made robust immediately. In this specification, the recording medium includes not only kinds of commonly used printing paper but also cloth, plastics, film, and many other kinds of printing or recording media. The transfer inkjet printing apparatus according to the present invention can have a constitution in which the recording medium is conveyed on a conveyor belt. However, its constitution is not limited to this; for example, a constitution in which a pressing roller around which the recording medium is wrapped is used as a conveyor drum is also allowed.

Cleaning

The processes described above are enough to finish a round of image formation; however, for the continuous and repeated use of the intermediate transfer body for a better productivity, its surface can be cleaned and refreshed before the next round of image formation. Any known cleaning and refreshing method can be used as needed. Examples of the methods that can be used for this purpose include showering with cleaning solution, wiping with a wet molleton-covered roller, contact with the surface of cleaning solution, scraping with a wiper blade, and exposure to some kind of energy. Needless to say, such methods can be used in combination of two or more kinds. Incidentally, the transfer inkjet printing apparatus illustrated in FIGURE has a cleaning unit 10 for cleaning the intermediate transfer body.

Transfer Inkjet Printing Apparatus

The transfer inkjet printing apparatus according to the present invention is a printing apparatus for the type of transfer inkjet printing method described above. The transfer inkjet printing apparatus according to the present invention can have a supporting member 3, an intermediate transfer body 11 held on it, a roller-based applicator 4, an inkjet device 5, a blower 6, a heater 7, a pressing roller 9, a cleaning unit 10, and optionally other members. With a printing apparatus constituted as above, one can print a high-quality image on a recording medium 8. As mentioned above, the roller-based applicator can be used as a device for applying the reaction solution described above to the intermediate transfer body, and is also allowed to have a constitution for continuous application of the reaction solution to the surface of the intermediate transfer body. The inkjet device can be used to eject image-forming ink to form an intermediate image on the intermediate transfer body, and the blower and the heater can be set up for the purpose of completely or partially removing the liquid component from the constituents of the intermediate image, namely, the ink and the reaction solution. The supporting member and the pressing roller sandwich the intermediate transfer body and the recording medium together and compress them at the line of contact and thereby contribute to the efficiency of the image transfer process. Furthermore, the cleaning unit can be used to clean and refresh the surface of the intermediate transfer body between a round of image formation and the next one.

The present inventors found, for the first time ever, that this embodiment of the present invention provided a printing (image-forming) apparatus for transfer inkjet recording that could produce prints of high commercial value with only a small difference in glossiness on the image-carrying areas and on the areas carrying no image regardless of the kind of recording medium.

Furthermore, this embodiment of the present invention may extend the life of the intermediate transfer body, improve the image transfer performance of the intermediate transfer body, and provide some other advantages.

EXAMPLES

The following describes some examples and comparative examples of the present invention.

Example 1

Preparation of the Intermediate Transfer Body

First, an intermediate transfer body having E1 and E2 specified in the Example 1 row in Table 1 and containing silicone rubber exposed on its surface was prepared by the following procedure. KE-1316 silicone rubber (Shin-Etsu Chemical Co., Ltd.) as the main material for the intermediate transfer body and BMI alumina-based needle-shaped fillers (Kawai Lime Industry CO., Ltd.) were kneaded together. The kneaded mixture was processed by hot rolling into a sheet having a thickness of approximately 150 μm; in this way, the intermediate transfer body was obtained in the form of a sheet. In this process, the rolling conditions were controlled so that flow shear stress could make the needle-shaped fillers oriented in the planar direction in the sheet (i.e., in the direction perpendicular to that of the pressure generated while the intermediate transfer body would be pressed and parallel to the direction of conveyance of the recording medium) in order that the compressive elastic moduli E1 and E2 should satisfy the relation E1<E2. Recall that E1 is the compressive elastic modulus of the intermediate transfer body measured in the direction parallel to the direction of the pressure generated while a recording medium is pressed onto the intermediate transfer body (i.e., the parallel-to-pressure compressive elastic modulus), and E2 is the compressive elastic modulus of the intermediate transfer body measured in the direction perpendicular to the direction of the pressure generated while a recording medium is pressed onto the intermediate transfer body and parallel to the direction of conveyance of the recording medium (i.e., the perpendicular-to-pressure compressive elastic modulus). The obtained intermediate transfer body was placed on a supporting member. A cylindrical drum made of aluminum alloy was used as the supporting member because this material is rigid enough to withstand the pressure generated during the image transfer process, can be prepared with a high dimensional accuracy, and the rotation of this drum was considered to be highly controllable owing to the alloy's low inertia.

Transfer Inkjet Printing Apparatus

With this intermediate transfer body held on the supporting member, a transfer inkjet printing apparatus having the constitution illustrated in FIGURE was assembled. The following details the assembly process. First, a roller-based applicator 4 was set up as a device for applying reaction solution, the first liquid, to the intermediate transfer body and to have a constitution for continuous application of the reaction solution to the surface of the intermediate transfer body. The reaction solution was an aqueous solution of a metal salt, or more specifically an aqueous solution that contained calcium chloride ($CaCl_2.2H_2O$) as an ink-thickening agent at a content ratio of 10 mass % and a surfactant as a surface tension modifier. The reaction solution was applied to the intermediate transfer body with its amount per unit area set at 1.0 g/m$^2$.

After the application of the first liquid, image-forming ink (the second liquid) was ejected from an inkjet device 5 to form an intermediate image (the mirror image of the finished image) on the intermediate transfer body. The inkjet device was an on-demand ink ejection device based on electro-thermal transducers, and the ink was a resin-dispersed pigment ink that contained a surfactant as a surface tension modifier.

The composition of this resin-dispersed pigment ink was as follows. The unit part means part by weight.

Composition of the Resin-Dispersed Pigment Ink

Pigment (coloring material): C.I. Pigment Blue 15, 3 parts

Dispersion resin: A styrene-acrylic acid-ethyl acrylate copolymer (acid value: 240; weight average molecular weight: 5000), 1 part Nonaqueous solvent 1: Glycerin, 10 parts Nonaqueous solvent 2: Ethylene glycol, 5 parts Water: Ion-exchanged water, 81 parts A blower 6 was set up for the purpose of completely or partially removing the liquid component from the constituents of the intermediate image, namely the ink and the reaction solution. Along with this, a heater 7 for heating the intermediate image from the back side was also set up. With these units, the intermediate image was dried. Also, a pressing roller 9 for bringing a recording medium into contact with the intermediate image formed on the intermediate transfer body to form a transferred image was set up. With this pressing roller 9, the intermediate image was transferred from the intermediate transfer body to a recording medium, and a transferred image was obtained thereby. In this image transfer process, the supporting member 3 and the pressing roller 9 sandwiched the surface of the intermediate transfer body, the intermediate image, and the recording medium together and compressed them at the line of contact. Several kinds of printing paper were used as the recording medium in order to evaluate the image transfer performance of the intermediate transfer body on this variety of recording media and how much the image shifted out of position while it was being transferred to each recording medium. Table 2 lists the kinds of printing paper used and their surface roughness $R_a$ (μm). These values of surface roughness $R_a$ of the individual kinds of printing paper were measured using SJ-201 surface roughness measuring machine (Mitsutoyo Corporation). Incidentally, the transfer inkjet printing apparatus was assembled to have a constitution in which the recording medium was conveyed on a conveyor belt.

Evaluation

Evaluation of Image Transfer Performance

For this transfer inkjet printing apparatus, fit with the intermediate transfer body prepared above, the image transfer performance was evaluated. In general, the greater the surface roughness $R_a$ of a recording medium is, the smaller the area of contact between an intermediate transfer body and the recording medium is; therefore, the image transfer performance of an intermediate transfer body is lower on recording media having a high surface roughness $R_a$ than on those having a low $R_a$. In the present invention, evaluations were made focusing on image transfer performance on paper having a high surface roughness, namely the matt coated paper (Mitsubishi Paper Mills Limited) among the recording media specified in Table 2. Specifically, the image transfer performance was evaluated by the following procedure: An image of a solid circle having a diameter of 2 cm was formed on the intermediate transfer body from the ink and the reaction solution, this image was transferred to a sheet of the matt coated paper, and then the image transferred to the sheet of the matt coated paper was visually inspected in accordance with the criteria presented below. The result is shown in Table 1.

Criteria for Image Transfer Performance

⊙: The image formed on the intermediate transfer body was transferred to the sheet of the matt coated paper very well.

○: The image formed on the intermediate transfer body was transferred to the sheet of the matt coated paper well.

Δ: The image formed on the intermediate transfer body was transferred to the sheet of the matt coated paper in an acceptable condition.

x: The image formed on the intermediate transfer body was not well transferred to the sheet of the matt coated paper.

Evaluation of Shift of Image (Image Quality)

In the same way as in the evaluation of image transfer performance described above, an image was formed on a sheet of the matt coated paper using the intermediate transfer body. Additionally, an inkjet recording apparatus (PIXUS 850i available from Canon Inc.) was used with a sheet of the matt coated paper to form an image of a solid circle having a diameter of 2 cm from its cyan ink. This inkjet recording apparatus has no intermediate transfer body. Thus, the present inventors regarded the image formed with this apparatus as an image having the same shape as that of an image to be transferred from the intermediate transfer body to a sheet of the matt coated paper, or in other words an image formed without shifting out of position. The shift of image (image quality) was evaluated by the following procedure: An image formed using the image transfer body and that formed using the inkjet recording apparatus were placed side-by-side, and then the image formed using the image transfer body was visually inspected for any displacement with respect to the image formed using the inkjet recording apparatus. The criteria used were as follows.

Criteria for Shift of Image

⊙: No image displacement was observed.

○: Only a slight image displacement was observed.

Δ: Some degree of image displacement was observed.

x: A distinct image displacement was observed.

Examples 2 to 12

Intermediate transfer bodies according to the present invention were prepared with their own E1 and E2 adjusted to the values specified in the Example 2 to Example 12 rows in Table 1. For the intermediate transfer bodies according to Examples 2 to 9, the main material was KE-1316 silicone rubber (Shin-Etsu Chemical Co., Ltd.); the intermediate transfer bodies according to Examples 2 to 9 were obtained as those containing silicone rubber exposed on their surface. As for the intermediate transfer bodies according to Examples 10 to 12, the main material was SIFEL3405A/B fluorocarbon rubber (Shin-Etsu Chemical Co., Ltd.); the intermediate transfer bodies according to Examples 10 to 12 were obtained as those containing fluorocarbon rubber exposed on their surface. In Examples 2, 3, and 10 to 12, the main material and the same alumina-based needle-shaped fillers as those used in Example 1 were kneaded together. In Examples 4 to 6, the main material and aluminum borate-based needle-shaped fillers (Shikoku Chemicals Corporation) were kneaded together. And, in Examples 7 to 9, the main material and polyimide-modified silicone (Shin-Etsu Silicone) as an orientable compound were kneaded together. The fillers or the orientable compound was contained at different content ratios among the examples. Then, as in Example 1, each of the kneaded mixtures was processed into a sheet having a thickness of approximately 150 μm, with the conditions controlled to make the fillers or molecules of the orientable compound oriented in the planar direction in the sheet in order that the relation E1<E2 should be satisfied; in this way, the intermediate transfer bodies were obtained in the form of sheets. In all these examples, the supporting member was the same as that for Example 1. A transfer inkjet printing apparatus was assembled in the same way as in Example 1 with each of the intermediate transfer bodies held on the supporting member, and then the image transfer performance and the shift of image (image quality) were evaluated for each intermediate transfer body. The results are shown in Table 1.

Comparative Examples 1 to 3

Intermediate transfer bodies were prepared to have isotropy in compressive elastic modulus as specified by E1 and E2 in the Comparative Example 1 to Comparative Example 3 rows in Table 1. For all the intermediate transfer bodies according to Comparative Examples 1 to 3, the main material was KE-1316 silicone rubber (Shin-Etsu Chemical Co., Ltd.), and the overall elastic modulus was adjusted by using spherical alumina fillers on an as-needed basis. Each of the obtained kneaded mixtures was processed into a sheet having a thickness of approximately 150 μm; the intermediate transfer bodies were obtained in the form of sheets. In all these comparative examples, the supporting member was the same as that for Example 1. A transfer inkjet printing apparatus was assembled in the same way as in Example 1 with each of the intermediate transfer bodies held on the supporting member, and then the image transfer performance and the shift of image (image quality) were evaluated for each intermediate transfer body. The results are shown in Table 1.

TABLE 1

| | E1 [MPa] | E2 [MPa] | Image transfer performance | Image quality |
|---|---|---|---|---|
| Example 1 | 3 | 4 | ⊙ | ○ |
| Example 2 | 7 | 10 | ⊙ | ○ |
| Example 3 | 11 | 17 | ⊙ | ⊙ |
| Example 4 | 10 | 16 | ⊙ | ⊙ |
| Example 5 | 21 | 32 | ⊙ | ⊙ |
| Example 6 | 28 | 41 | ⊙ | ○ |
| Example 7 | 41 | 49 | ○ | ○ |
| Example 8 | 55 | 62 | ○ | ○ |
| Example 9 | 67 | 102 | ○ | ⊙ |
| Example 10 | 5 | 7 | ⊙ | ○ |
| Example 11 | 21 | 35 | ⊙ | ⊙ |
| Example 12 | 56 | 85 | ○ | ⊙ |
| Comparative Example 1 | 4 | | ⊙ | X |
| Comparative Example 2 | 40 | | ○ | Δ |
| Comparative Example 3 | 100 | | X | ○ |

TABLE 2

| Recording medium | $R_a$ [μm] |
|---|---|
| Cast-coated paper (Oji paper Co., Ltd.) | 0.25 |
| Wood-free coated paper (Nippon Paper Group, Inc.) | 1.18 |
| Fine-coated paper (Oji paper Co., Ltd.) | 2.07 |
| Matt coated paper (Mitsubishi Paper Mills Limited) | 2.77 |

As can be seen from these results, the present invention can provide an intermediate transfer body for transfer inkjet printing that can transfer an image to a wide variety of recording media and on which the image is prevented from shifting out of position while it is being transferred to a recording medium, and also a transfer inkjet printing apparatus having such an intermediate transfer body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-068192 filed Mar. 24, 2010, which is hereby incorporated by reference herein in its entirety.

What is claimed is:

1. A transfer inkjet printing method comprising:

selectively applying an ink for forming some image using an inkjet device to an intermediate transfer body to form an image; and pressing a recording medium onto the image so that the image should be transferred from the intermediate transfer body to the recording medium to form a transferred image, wherein the intermediate transfer body has E1 and E2 satisfying a relation E1<E2, where E1 is a compressive elastic modulus of the intermediate transfer body measured in a direction parallel to a direction of a pressure generated while the recording medium is pressed onto the intermediate transfer body, and E2 is a compressive elastic modulus of the intermediate transfer body measured in a direction perpendicular to a direction of a pressure generated while the recording medium is pressed onto the intermediate transfer body and parallel to a direction of conveyance of the recording medium, and wherein $$E1\times1.5<E2,$$

$$10(\text{MPa})\leq E1\leq30(\text{MPa}); \text{ and}$$

$$10(\text{MPa})\leq E2\leq40(\text{MPa}).$$

2. The transfer inkjet printing method according to claim 1, wherein the intermediate transfer body comprises a fluorocarbon rubber exposed on a surface thereof.

3. The transfer inkjet printing method according to claim 1, wherein the intermediate transfer body comprises a silicone rubber exposed on a surface thereof.

4. The transfer inkjet printing method according to claim 1, wherein the intermediate transfer body comprises a needle-shaped filler.

5. The transfer inkjet printing method according to claim 1, wherein the intermediate transfer body comprises a compound whose molecules or crystals can be oriented in a certain direction.

* * * * *